US008760383B2

(12) United States Patent
Yang et al.

(10) Patent No.: US 8,760,383 B2
(45) Date of Patent: Jun. 24, 2014

(54) BACKLIGHT MODULE FOR DISPLAYS

(75) Inventors: Cheng-Feng Yang, Tainan (TW); Cheng-I Wu, Chia-Yi (TW); Shih-Pin Huang, Tainan (TW)

(73) Assignee: Innolux Corporation, Miao-Li County (TW)

( * ) Notice: Subject to any disclaimer, the term of this patent is extended or adjusted under 35 U.S.C. 154(b) by 1174 days.

(21) Appl. No.: 12/428,076

(22) Filed: Apr. 22, 2009

(65) Prior Publication Data

US 2009/0267530 A1 Oct. 29, 2009

(30) Foreign Application Priority Data

Apr. 23, 2008 (TW) ..... 97114942 A

(51) Int. Cl.
*H05B 41/16* (2006.01)
*H05B 41/24* (2006.01)
*G09G 3/36* (2006.01)

(52) U.S. Cl.
USPC ..... 345/102; 315/287

(58) Field of Classification Search
USPC ..... 345/102; 315/291, 246, 250, 287; 331/34
See application file for complete search history.

(56) References Cited

U.S. PATENT DOCUMENTS

| | | | | |
|---|---|---|---|---|
| 6,188,206 | B1 * | 2/2001 | Nguyen et al. | 323/222 |
| 6,812,649 | B2 * | 11/2004 | Kim | 315/149 |
| 7,348,960 | B2 * | 3/2008 | Huang et al. | 345/102 |
| 7,482,760 | B2 * | 1/2009 | Jungwirth et al. | 315/185 R |
| 7,825,883 | B2 * | 11/2010 | Yao | 345/87 |
| 8,120,280 | B2 * | 2/2012 | Yi et al. | 315/294 |
| 2004/0113907 | A1 * | 6/2004 | Lee et al. | 345/211 |
| 2005/0052168 | A1 * | 3/2005 | Tazawa et al. | 323/282 |
| 2005/0057170 | A1 * | 3/2005 | Yu et al. | 315/167 |
| 2006/0017402 | A1 * | 1/2006 | McKinney et al. | 315/291 |
| 2006/0127066 | A1 * | 6/2006 | Chiu et al. | 388/804 |
| 2007/0024574 | A1 | 2/2007 | Wu | |
| 2007/0057900 | A1 * | 3/2007 | Huang | 345/102 |
| 2007/0103086 | A1 * | 5/2007 | Neudorf et al. | 315/149 |
| 2007/0216458 | A1 * | 9/2007 | Chiu et al. | 327/175 |
| 2008/0048582 | A1 * | 2/2008 | Robinson | 315/291 |
| 2008/0061759 | A1 * | 3/2008 | Lin et al. | 323/290 |
| 2008/0175029 | A1 * | 7/2008 | Jung et al. | 363/79 |
| 2008/0224629 | A1 * | 9/2008 | Melanson | 315/247 |
| 2008/0225563 | A1 * | 9/2008 | Seo | 363/123 |

(Continued)

FOREIGN PATENT DOCUMENTS

| | | |
|---|---|---|
| TW | I272562 | 2/2007 |
| TW | 200710786 | 3/2007 |

OTHER PUBLICATIONS

Upal Sengupta Presented by Fredric Cha, "PWM and PFM Operation of DC—DC Converters for Portable Applications", 2007 Portable Power Design Seminar Topic 7, Technology for Innovators, Texas Instruments, Jul. 1 thru Jul. 23, 2007.
TW Office Action dated Nov. 19, 2012.

(Continued)

*Primary Examiner* — Bipin Shalwala
*Assistant Examiner* — Matthew Fry
(74) *Attorney, Agent, or Firm* — McClure, Qualey & Rodack, LLP

(57) ABSTRACT

A backlight module includes a light-emitting unit, and a controller to receive a first control signal and generate a second control signal to control the light-emitting unit. The controller controls a frequency of the second control signal according to a duty cycle of the first control signal.

14 Claims, 5 Drawing Sheets

(56) References Cited

U.S. PATENT DOCUMENTS

| | | | | |
|---|---|---|---|---|
| 2008/0252236 | A1* | 10/2008 | Lee et al. | 315/308 |
| 2009/0184666 | A1* | 7/2009 | Myers et al. | 315/297 |
| 2009/0261748 | A1* | 10/2009 | McKinney et al. | 315/254 |
| 2010/0219764 | A1* | 9/2010 | Yamasaki et al. | 315/224 |
| 2011/0292694 | A1* | 12/2011 | Ye et al. | 363/21.18 |
| 2012/0074860 | A1* | 3/2012 | Lee | 315/240 |
| 2012/0147062 | A1* | 6/2012 | Seo et al. | 345/690 |
| 2013/0321484 | A1* | 12/2013 | Kim et al. | 345/690 |

OTHER PUBLICATIONS

English Abstract translation of TWI272562 (Published Feb. 1, 2007).
English Abstract translation of TW200710786 (Published Mar. 16, 2007).

* cited by examiner

BACKLIGHT MODULE FOR DISPLAYS

CROSS REFERENCE TO RELATED APPLICATIONS

This application claims priority to Taiwan application Serial No. 097114942, filed Apr. 23, 2008. The entire content of the above application is incorporated by reference.

BACKGROUND

The description relates to backlight module for displays.

In some examples, a liquid crystal display (LCD) includes a backlight module that provides backlight to illuminate pixels of a liquid crystal display panel to show images.

FIG. 1 is a block diagram of an example backlight module 1. The backlight module 1 includes a power converter 11, a plurality of light-emitting diodes (LEDs) 12, and a current regulator 13. The power converter 11 converts a first power signal VS11 into a second power signal VS12, and outputs the second power signal VS12 to drive the LEDs 12 to emit light. The current regulator 13 receives a control signal CS11 that controls currents flowing through the LEDs 12. The control signal CS11 can have a constant frequency. The luminance of the LEDs 12 can be adjusted by tuning the duty cycle of the control signal CS11. Increasing or decreasing the duty cycle of the control signal CS11 causes the luminance of the LEDs 12 to increase or decrease, respectively.

SUMMARY

In one aspect, in general, a liquid crystal display includes a backlight module that is driven in a way to have a small power loss and low flickering when the display operates with low luminance, thereby increasing the display quality. For example, the backlight module can include a light-emitting unit and a frequency adjusting control unit. The light-emitting unit is electrically connected to the frequency adjusting control unit. The frequency adjusting control unit receives a first control signal and generates a second control signal at least having a first frequency or a second frequency in accordance with a duty cycle of the first control signal to control the light-emitting unit.

In another aspect, in general, a backlight module includes a light-emitting unit, and a controller to receive a first control signal and generate a second control signal to control the light-emitting unit. The controller controls a frequency of the second control signal according to a duty cycle of the first control signal.

Implementations can include one or more of the following features. The controller causes the second control signal to have a first frequency or a second frequency based on a comparison of the duty cycle of the first control signal and a first threshold value. The first threshold value is between 15% to 25%. For example, the first threshold value can be 20%. The first frequency is between 180 Hz to 220 Hz. For example, the first frequency can be 200 Hz. The second frequency is between 9 KHz to 11 KHz. For example, the second frequency can be 10 KHz. The controller causes the second control signal to have a first frequency, a second frequency, or a third frequency based on a comparison of the duty cycle of the first control signal and a first threshold value and a second threshold value. The average luminance of the light-emitting unit varies according to the duty cycle of the second control signal. The first control signal and the second control signal have the same duty cycle. The light-emitting unit includes a plurality of light-emitting diodes and a current regulator to regulate currents that pass the light-emitting diodes. The second control signal controls the current regulator in regulating the currents. A liquid crystal display panel is illuminated by the backlight module.

In another aspect, in general, a light source includes a light-emitting unit, and a controller to receive a first control signal and generate a second control signal to control the light-emitting unit. The controller controls a frequency of the second control signal according to a duty cycle of the first control signal. A reflective display device is illuminated by the light source.

In another aspect, in general, a method for driving a backlight module having a light-emitting unit includes the following. A first control signal is received, a determination is made is as to whether a duty cycle of the first control signal is larger than or equal to a first threshold value, a second control signal having a first frequency is output to a light-emitting unit if the duty cycle of the first control signal is larger than or equal to the first threshold value, and a second control signal having a second frequency is output to the light-emitting unit if the duty cycle of the first control signal is smaller than the first threshold value.

Implementations can include one or more of the following features. The first control signal and the second control signal have the same duty cycle. The first threshold value is between 15% to 25%. For example, the first threshold value can be 20%. The first frequency is between 180 Hz to 220 Hz. For example, the first frequency can be 200 Hz. The second frequency is between 9 KHz to 11 KHz. For example, the second frequency can be 10 KHz. If the duty cycle of the first control signal is smaller than the first threshold value, a determination is made as to whether the duty cycle of the first control signal is larger than or equal to a second threshold value that is smaller than the first threshold value. The second control signal having the second frequency is output to the light-emitting unit if the duty cycle of the first control signal is larger than or equal to the second threshold value, and the second control signal having a third frequency is output to the light-emitting unit if the duty cycle of the first control signal is less than the second threshold value.

In another aspect, in general, a liquid crystal display includes a liquid crystal display panel having a plurality of pixels; a light-emitting unit to generate light to illuminate the pixels; and a frequency controller to receive a first control signal and generate a second control signal that is sent to the light-emitting unit to control an average luminance of the light-emitting unit. The second control signal alternates between high and low levels and has a first frequency if a duty cycle of the first control signal is greater than or equal to a threshold value. The second control signal has a second frequency if the duty cycle of the first control signal is less than the threshold value. The light-emitting unit emits light according to a frequency and duty cycle that correspond to the frequency and duty cycle of the second control signal.

Implementations can include the following feature. The first control signal and the second control signal have the same duty cycle.

In another aspect, in general, a backlight module includes a light-emitting unit and a frequency adjusting control unit that is electrically connected to the light-emitting unit. Driving the backlight module includes receiving a first control signal at the frequency adjusting control unit, determining whether a duty cycle of the first control signal is larger than a first threshold value, and outputting a second control signal having a first frequency from the frequency adjusting control unit to the light-emitting unit if the duty cycle of the first control signal is larger than or equal to the first threshold value. The frequency adjusting control unit outputs a second control signal having a second frequency to the light-emitting unit if the duty cycle of the first control signal is smaller than the first threshold value.

Other aspects can include other combinations of the features recited above and other features, expressed as methods, apparatus, systems, program products, and in other ways.

Advantages may include one or more of the following. Flickering can be reduced, switching power loss can be reduced, electromagnetic interference can be reduced, and display quality can be enhanced.

DETAILED DESCRIPTION

The following describes a display having a backlight module that varies the duty cycle of currents passing light emitting devices to adjust the overall luminance of the display. The currents are switched on and off at a frequency that is selected according to the duty cycle. This can reduce flicker, increase power efficiency, reduce electromagnetic interference, and enhance the quality of the display.

Figure 1:
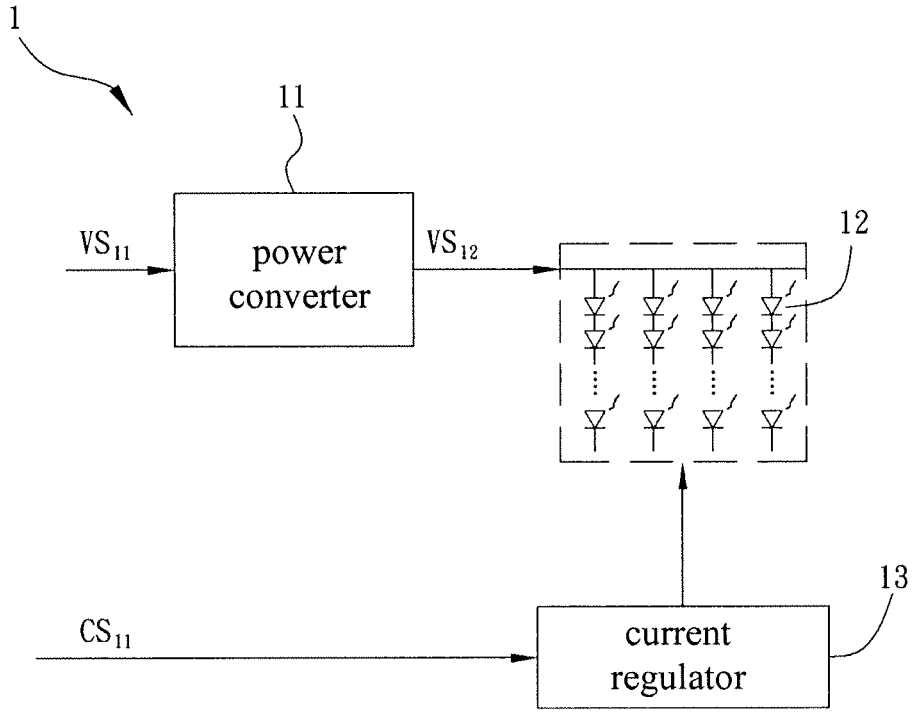
FIG. 1(PRIOR ART)
FIG. 1 is a schematic diagram of an example backlight module.
Figure 2:
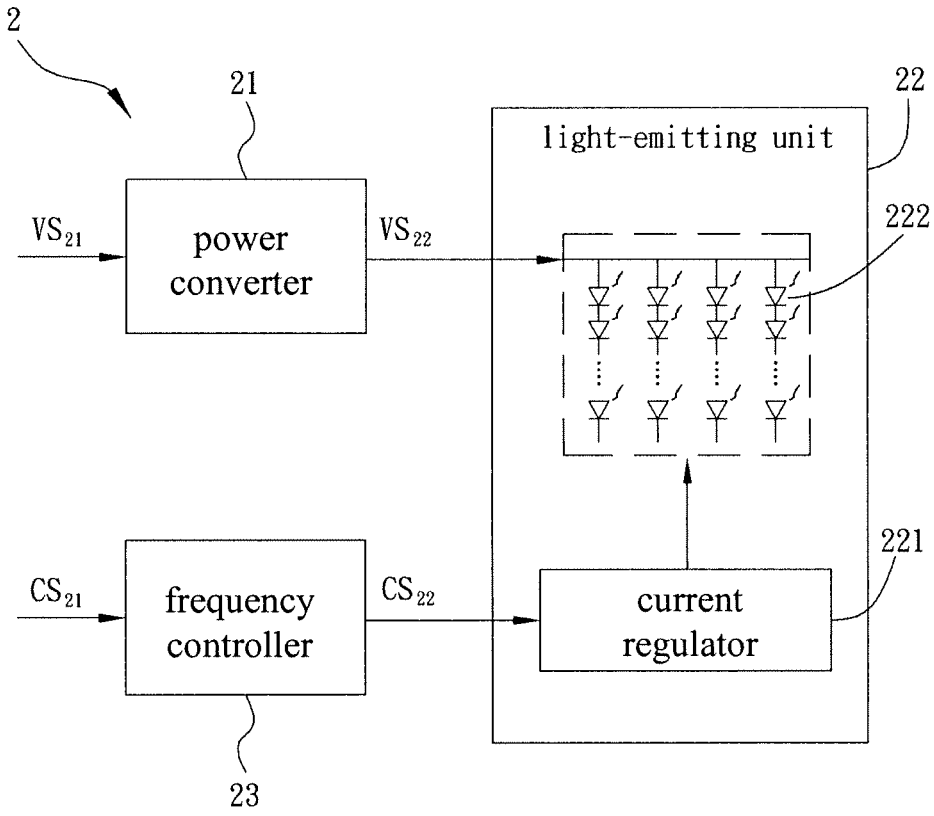
FIG. 2 is a schematic diagram of an example backlight module.

FIG. 2 is a schematic diagram of an example backlight module 2 that includes a power converter 21, a light-emitting unit 22, and a frequency controller 23. The light-emitting unit 22 includes a current regulator 221 and a plurality of light-emitting devices 222. For example, the light-emitting devices 222 can be light-emitting diodes (LEDs) 222. The LEDs 222 can be grouped to form several light bars each including several LEDs 222 connected in series positioned along a column-wise direction, and several light bars can be connected in parallel. The current regulator 221 controls the electric currents flowing through the light bars. In some implementations, the frequency controller 23 controls switches in the current regulator 221 to control the frequency that the currents flowing through the LEDs 222 are turned on and off, and the duty cycle of the currents.

The power converter 21 receives a first power signal VS21 and converts the first power signal VS21 into a second power signal VS22. The second power signal VS22 provides power to drive the light-emitting unit 22. In some examples, the first power signal VS21 and the second power signal VS22 are voltage signals. For example, the power converter 21 can be a pulse width modulation (PWM) DC-to-DC voltage converter, the first power signal VS21 can be a DC voltage signal having a level between 7.5V and 21V, and the second power signal VS22 can be a DC voltage signal having a level of about 40V. In some examples, the first power signal VS21 or the second power signal VS22 can be a current signal.

The frequency controller 23 receives a first control signal CS21 and generates a second control signal CS22 having a frequency that is determined according to a duty cycle of the first control signal CS21. The frequency controller 23 may also be referred to as a frequency adjustment controller unit. For example, the second control signal CS22 can have a first frequency or a second frequency that depends on whether a duty cycle of the first control signal CS21 is greater than, equal to, or less than a threshold value. In some examples, the second control signal CS22 can have a frequency that is selected from three or more frequencies, the selection being dependent on the duty cycle of the first control signal CS21. The second control signal CS22 is sent to the current regulator 221 to control the currents passing the LEDs 222. In some implementations, the frequency controller 23 can be disposed in a control chip or a timing controller of a display.

Figure 3:
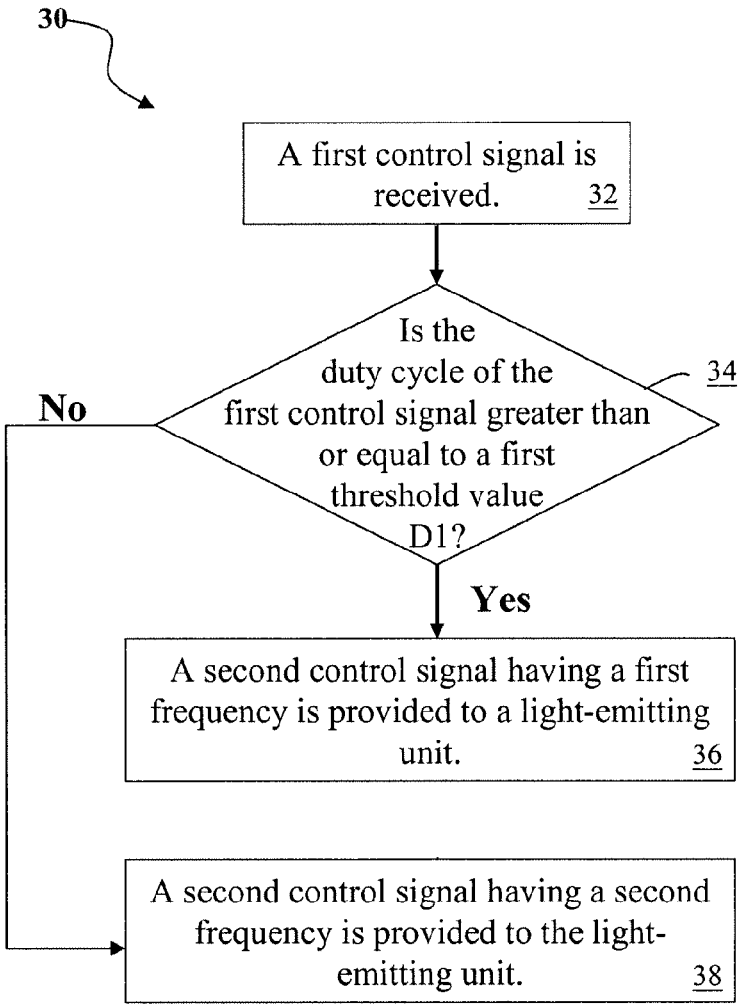
FIG. 3 is a flow chart of an example process for driving a backlight module.

FIG. 3 shows a process 30 for driving a backlight module, such as the backlight module 2 of FIG. 2. A first control signal is received (32). The first control signal can alternate between a high level and a low level. For example, the first control signal can be the first control signal CS21. The first control signal can be received at the frequency controller 23.

The duty cycle of the first control signal is compared with a first threshold value D1 (34). In some examples, the first threshold value D1 is about 20%, and the frequency controller 23 can determine whether the duty cycle of the first control signal CS21 is larger than, equal to, or smaller than the first threshold value D1.

If the duty cycle of the first control signal is larger than or equal to the first threshold value D1, a second control signal having a first frequency is provided to a light-emitting unit (36). For example, the light-emitting unit can be the light-emitting unit 22. The second control signal can be the second control signal CS22 of FIG. 2, and the first frequency of the second control signal can be about 200 Hz. The second control signal can be output by the frequency controller 23.

If the duty cycle of the first control signal is less than the first threshold value D1, a second control signal having a second frequency is provided to the light-emitting unit (38). In some examples, the second frequency can be about 10 KHz. The duty cycles of the first control signal (e.g., CS21) and the second control signal (e.g., CS22) can be the same.

In some implementations, the frequency controller 23 may compare the first control signal CS21 with two or more threshold values, and the frequency controller 23 may output the second control signal CS22 having a frequency selected from three or more frequencies. For example, when the duty cycle of the first control signal CS21 is larger than or equal to a first threshold value, the frequency controller 23 causes the second control signal CS22 to have a first frequency. When the duty cycle of the first control signal CS21 is less than the first threshold value, but larger than or equal to a second threshold value, the frequency controller 23 causes the second control signal CS22 to have a second frequency. When the duty cycle of the first control signal CS21 is less than the second threshold value, the frequency controller 23 causes the second control signal CS22 to have a third frequency. In this example, the second threshold value is smaller than the first threshold value.

Figure 4A:
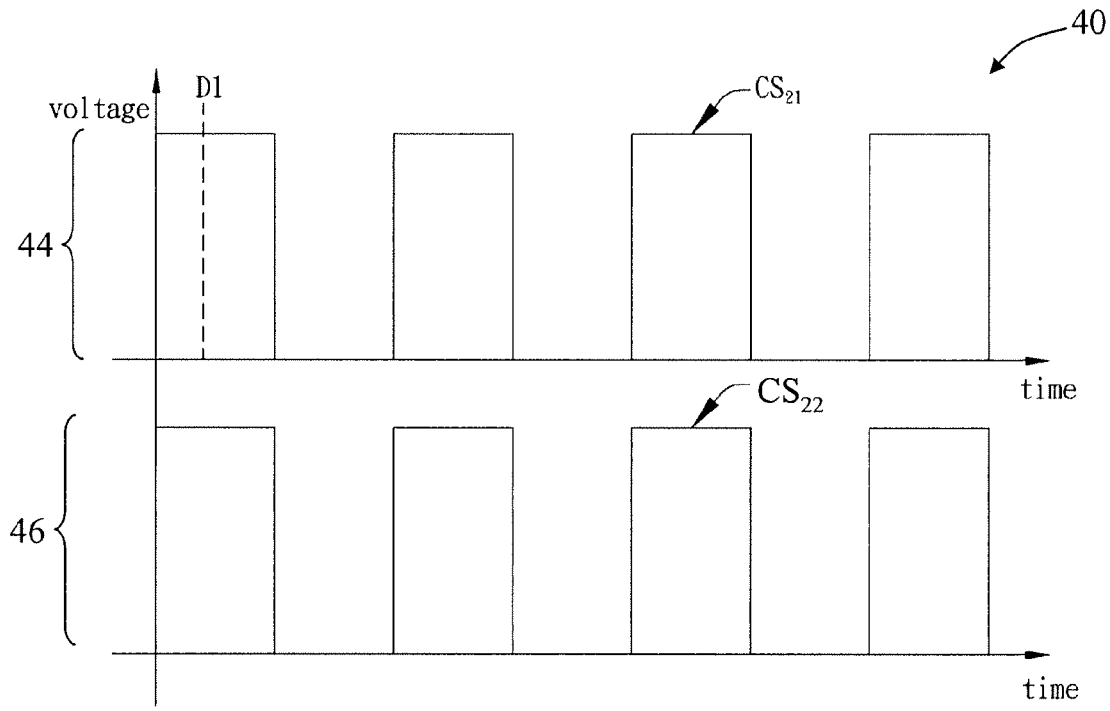
FIGS. 4A and 4B are graphs of example first and second control signals associated with the backlight module.

FIG. 4A is a graph 40 showing a waveform 44 of the first control signal CS21 and a waveform 46 of the second control signal CS22 having the first frequency in response to a determination by the frequency controller 23 that the duty cycle of the first control signal CS21 is larger than or equal to the first threshold value D1.

Figure 4B:
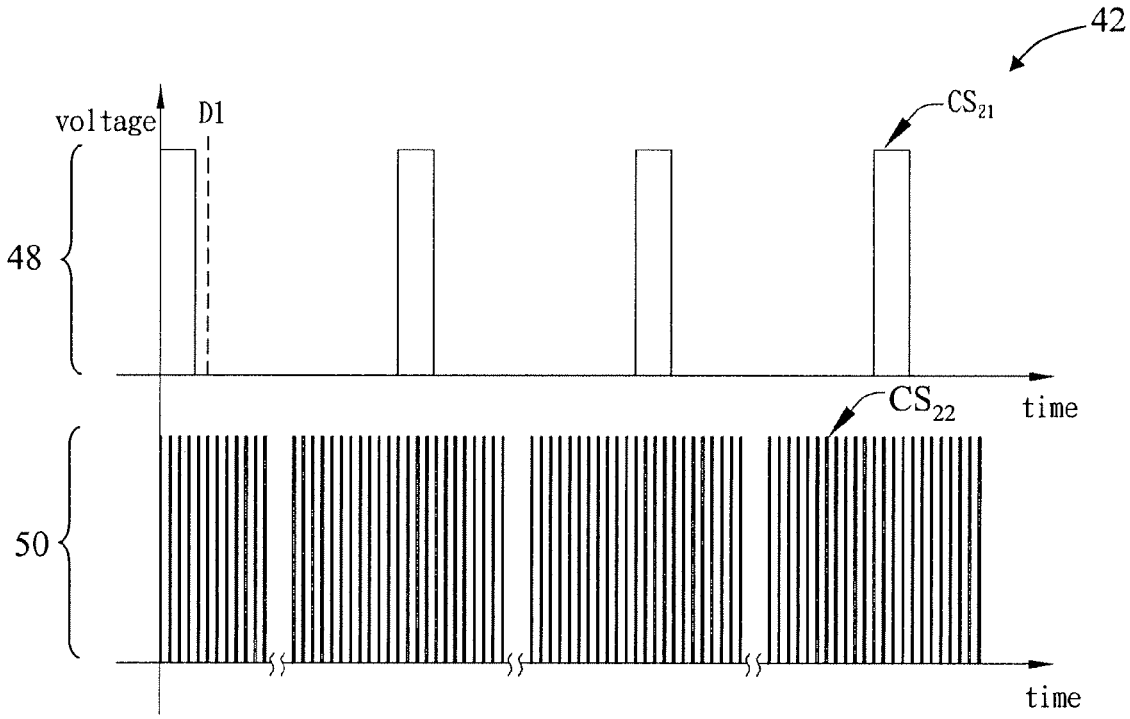

FIG. 4B is a graph 42 showing a waveform 48 of the first control signal CS21 and a waveform 50 of the second control signal CS22 having the second frequency in response to a determination by the frequency controller 23 that the duty cycle of the first control signal CS21 is less than the first threshold value D1.

In the example of FIG. 4A, the frequency of the second control signal CS22 is the same as the frequency of the first control signal CS21. The frequency of the second control signal CS22 can also be different from the frequency of the first control signal CS21 when the duty cycle of the first control signal CS21 is larger than or equal to the first threshold value D1. The frequency controller 23 can be configured such that the first control signal CS21 can have a range of frequencies, while the values for the first and second frequencies remain unchanged. In other words, the frequency of the first control signal CS21 does not affect the frequency of the second control signal CS22. Only the duty cycle of the first control signal CS21 affects the frequency of the second control signal CS22.

In some implementations, the LEDs 222 are turned on when the second control signal CS22 has a high level, and the LEDs 222 are turned off when the second control signal CS22 has a low level. Thus, the duty cycle of the second control signal CS22 affects the percentage of time that the LEDs 222 are turned on, thereby affecting the overall luminance of the light-emitting unit 22.

When the duty cycle of the currents passing the LEDs 222 is high (e.g., duty cycle >20%), the switching on and off of the LEDs 222 does not greatly affect the viewing experience of a viewer of the display. However, when the duty cycle of the currents passing the LEDs 222 is low (e.g., duty cycle <20%), if the frequency of the switching on and off of the LEDs 222 is low (e.g., 200 Hz), viewers may be able to detect flickering on the display, adversely affecting the viewing experience. When the frequency of the switching on and off of the LEDs 222 is increased (e.g., to 10 KHz), viewers are likely not able to detect such high frequency switching and will not perceive flickering on the display.

Switching the LEDs 222 at a high frequency reduces the power efficiency. By switching the LEDs 222 at a high frequency only when the display is turned dim (e.g., when the duty cycle of the first control signal CS21 is low) and switching the LEDs 222 at a low frequency when the display is turned bright (e.g., when the duty cycle of the first control signal CS21 is high), the display can operate at a high efficiency when the display is turned bright, allowing the overall efficiency of the display to be high.

Generating high frequency control signals and switching the LEDs 222 at a high frequency may generate electromagnetic interference. By switching the LEDs 222 at a high frequency only when the display is turned dim and switching the LEDs 222 at a low frequency when the display is turned bright, the display can operate with low electromagnetic interference when the display is turned bright, allowing the overall electromagnetic interference of the display to be low.

The first control signal CS21 and the first power signal VS21 can be generated by, e.g., a controller in a micro-control unit, a notebook computer, a desktop computer, or a monitor system. For example, a notebook computer may allow a user to adjust the brightness of the display. When the user chooses to increase the brightness of the display, the controller in the notebook computer increases the duty cycle of the first control signal CS21, causing the LEDs 222 to be turned on for a larger percentage of time, so that the display becomes brighter. When the user chooses to reduce the brightness of the display, the controller in the notebook computer decreases the duty cycle of the first control signal CS21, causing the LEDs 222 to be turned on for a smaller percentage of time, so that the display becomes dimmer.

Figure 5:
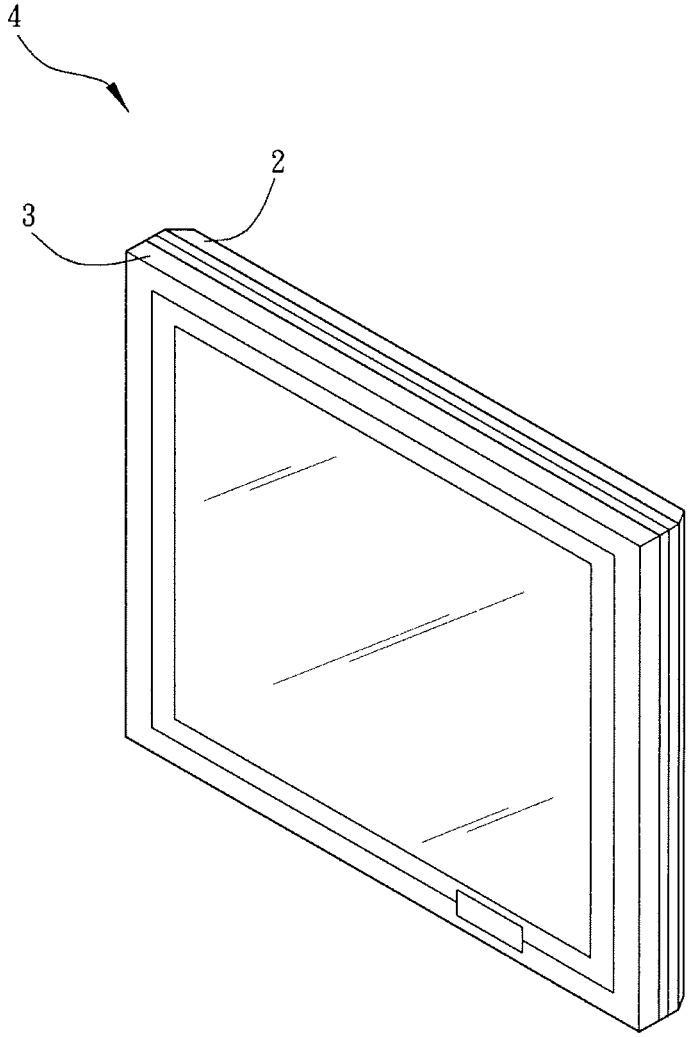
FIG. 5 is a schematic diagram of an example liquid crystal display.

Referring to FIG. 5, in some implementations, the backlight module 2 can be used in a liquid crystal display 4, which uses backlight generated by the backlight module 2 to illuminate pixels of an LCD panel 3. In some examples, the frequency controller 23 can be disposed on the LCD panel 3 instead of the backlight module 2.

A number of implementations have been described. Nevertheless, it will be understood that various modifications may be made without departing from the spirit and scope of the invention. For example, various forms of the flows shown above may be used, with steps re-ordered, added, or removed. Also, although several applications and methods have been described, it should be recognized that numerous other applications are contemplated. The backlight module can use voltage and frequency values that are different from those described above. The display 4 can have light valves other than those based on liquid crystal technology. The backlight can be used as a light source in a projector, in which the light from the backlight is focused by lens optics on a light modulator and then projected on a screen. The projector can be used in a projection television, or for use in a digital cinema. A light source that adjusts the duty cycle of light emitting devices to change the overall luminance, and adjusts the frequency of the switching of the light emitting devices according to the duty cycle, can be used to illuminate reflection type displays.

What is claimed is:

1. An apparatus comprising:

a backlight module comprising:

a light-emitting unit comprising a plurality of light-emitting diodes; and a controller, for receiving a first control signal and generating a second control signal to digitally control an average luminance of the light-emitting unit, the controller causes the second control signal to have a first frequency if a duty cycle of the first control signal is larger than a threshold value, and causes the second control signal to have a second frequency if the duty cycle of the first control signal is less than the threshold value, wherein the frequency of the first control signal is predetermined, the first frequency is equal to the frequency of the first control signal ,and the second frequency is larger than the first frequency;

wherein the second control signal leads all of the light-emitting diodes of the light-emitting unit to simultaneously provide all pixels of a liquid crystal display panel the average luminance.

2. The apparatus of claim 1 in which the first threshold value is between 15% to 25%.

3. The apparatus of claim 1 in which the first frequency is between 180 Hz to 220 Hz.

4. The apparatus of claim 3 in which the second frequency is between 9 KHz to 11 KHz.

5. The apparatus of claim 1 in which the average luminance of the light-emitting unit varies according to the duty cycle of the second control signal.

6. The apparatus of claim 1 in which the light-emitting unit further comprises a current regulator to regulate currents that pass the light-emitting diodes.

7. The apparatus of claim 6 in which the second control signal controls the current regulator in regulating the currents.

8. An apparatus comprising:

a light source comprising:

a light-emitting unit comprising a plurality of light-emitting diodes; and a controller to receive, for receiving a first control signal and generating a second control signal to digitally control an average luminance of the light-emitting unit, the controller causes the second control signal to have a first frequency if a duty cycle of the first control signal is larger than a threshold value, and causes the second control signal to have a second frequency if the duty cycle of the first control signal is less than the threshold value, wherein the frequency of the first control signal is predetermined, the first frequency is equal to the frequency of the first control signal ,and the second frequency is larger than the first frequency; and a reflective display device that is illuminated by the light source;

wherein the second control signal leads all of the light-emitting diodes of the light-emitting unit to simultaneously provide all pixels of a liquid crystal display panel the average luminance.

9. A method for digitally driving a backlight module comprising a light-emitting unit, the light-emitting unit comprises a plurality of light-emitting diodes, the method comprises:

receiving a first control signal;

determining whether a duty cycle of the first control signal is larger than or equal to a first threshold value, wherein the frequency of the first control signal is predetermined;

outputting a second control signal having a first frequency to the light-emitting unit if the duty cycle of the first control signal is larger than or equal to the first threshold value, the first frequency is equal to the frequency of the first control signal; and outputting a second control signal having a second frequency to the light-emitting unit if the duty cycle of the first control signal is smaller than the first threshold value, the second frequency is larger than the first frequency;

wherein the second control signal leads all of the light-emitting diodes of the light-emitting unit to simultaneously provide all pixels of a liquid crystal display panel the average luminance.

10. The method of claim 9 in which the first threshold value is between 15% to 25%.

11. The method of claim 9 in which the first frequency is between 180 Hz to 220 Hz.

12. The method of claim 9 in which the second frequency is between 9 KHz to 11 KHz.

13. The method of claim 9, further comprising, if the duty cycle of the first control signal is smaller than the first threshold value, determining whether the duty cycle of the first control signal is larger than or equal to a second threshold value that is smaller than the first threshold value, outputting the second control signal having the second frequency to the light-emitting unit if the duty cycle of the first control signal is larger than or equal to the second threshold value, and outputting the second control signal having a third frequency to the light-emitting unit if the duty cycle of the first control signal is less than the second threshold value.

14. A liquid crystal display, comprising:

a liquid crystal display panel having a plurality of pixels;

a light-emitting unit comprising a plurality of light-emitting diodes; and a frequency controller, for receiving a first control signal and generating a second control signal that is sent to the light-emitting unit to digitally control an average luminance of the light-emitting unit, the second control signal alternating between high and low levels and having a first frequency if a duty cycle of the first control signal is greater than or equal to a threshold value, the second control signal having a second frequency if the duty cycle of the first control signal is less than the threshold value, the light-emitting unit emitting light according to a frequency and duty cycle that correspond to the frequency and duty cycle of the second control signal;

wherein the frequency of the first control signal is predetermined, the first frequency is equal to the frequency of the first control signal ,and the second frequency is larger than the first frequency, and the second control signal leads all of the light-emitting diodes of the light-emitting unit to simultaneously provide all pixels of the liquid crystal display panel the average luminance.

* * * * *